United States Patent [19]

Wimberger

[11] Patent Number: 5,035,066

[45] Date of Patent: Jul. 30, 1991

[54] ULTRAVIOLET AIR FLOATATION BAR

[75] Inventor: Richard J. Wimberger, DePere, Wis.

[73] Assignee: W. R. Grace & Co.-Conn., Lexington, Mass.

[21] Appl. No.: 203,138

[22] Filed: Jun. 7, 1988

[51] Int. Cl.[5] ..... F26B 13/00

[52] U.S. Cl. ..... 34/156; 34/4; 34/41

[58] Field of Search ..... 34/4, 41, 156, 68

[56] References Cited

U.S. PATENT DOCUMENTS

| | | | |
|---|---|---|---|
| 3,499,232 | 3/1970 | Zimmermann | 34/68 |
| 4,021,931 | 5/1977 | Russ et al. | 34/156 |
| 4,146,974 | 4/1979 | Pray | 34/4 X |
| 4,290,210 | 9/1981 | Johansson | 34/156 |
| 4,434,562 | 5/1984 | Bubley et al. | 34/4 |
| 4,494,316 | 1/1985 | Stephansen et al. | 34/68 |
| 4,513,516 | 4/1985 | Bjornberg | 34/41 |
| 4,594,795 | 6/1986 | Stephansen | 34/4 |
| 4,638,571 | 1/1987 | Cook | 34/68 |
| 4,854,052 | 8/1989 | Korpela | 34/41 |

FOREIGN PATENT DOCUMENTS

| | | | |
|---|---|---|---|
| 2351280 | 1/1979 | Fed. Rep. of Germany . | |
| 352121 | 7/1972 | Sweden . | |
| 8303172-4 | 6/1983 | Sweden . | |
| 7812565-5 | 9/1983 | Sweden . | |
| 626711 | 9/1978 | Switzerland . | |
| 1977U7 | 7/1977 | U.S.S.R. . | |
| 1443679 | 7/1976 | United Kingdom | 34/156 |

*Primary Examiner*—Henry A. Bennett
*Assistant Examiner*—John Sollecito
*Attorney, Agent, or Firm*—Hugh D. Jaeger

[57] ABSTRACT

Ultraviolet air float bar for use in floating and drying a continuous planar web of a material in a dryer. Direct radiated or reflected ultraviolet electromagnetic energy from an ultraviolet bulb in a removable air bar channel assembly accelerates drying, or evaporation of solvents, or curing of planar web material passing in proximity to the ultraviolet air float bar either by ultraviolet electromagnetic energy, or in combination with Coanda air flow. The ultraviolet bulb is cooled by pressurized air passing through an interior portion of the removable air bar channel.

21 Claims, 10 Drawing Sheets

ULTRAVIOLET AIR FLOATATION BAR

CROSS REFERENCES TO CO-PENDING APPLICATIONS

Co-pending U.S. patent application Ser. No. 07/203,076, filed Jun. 7, 1988, and assigned to the assignee of the present invention.

BACKGROUND OF THE INVENTION

1. Field of the Invention

The present invention relates to an air float bar for use in positioning, drying or curing of a continuous planar flexible material such as a web, printed web, news print, film material, or plastic sheet. The present invention more particularly, pertains to an air float bar whose pressure pad area includes an ultraviolet bulb, a reflector surface and a lens to enhance accelerated ultraviolet heating of a web material to cause solvent evaporation, drying or curing. Electromagnetic ultraviolet heat energy in combination with columns of heated air impinging upon the web surface provides for concentrated heating of the web material thereby providing subsequent rapid evaporation, drying or curing from the surface of the material.

2. Description of the Prior Art

Demand for increased production volume and production speed of web material in dryers has caused the printing industry to increase web speed on their printing lines. Typically this speed-up requirement resultant in the dryer being inadequate in drying the web, because the web did not remain in the dryer adjacent to a series of air bars for a sufficient length of time to dry the web because of the increase web speed. The solution for adequate drying was to either replace the entire dryer with a longer dryer, or to add additional drying zones in series with a first dryer zone. This, of course, is expensive and ofter times not feasible due to a shortage of physical floor space.

The present invention overcomes the disadvantages of the prior art dryers by providing an ultraviolet air float bar to replace existing air float bars in web dryers. In addition to air flow of dry air from the Coanda air flow slots at the upper and outer extremities of the air float bar, an ultraviolet bulb, including a reflector and a lens, positioned between the Coanda air flow slots, transmits ultraviolet electromagnetic radiation to the traversing web. The transversing web drying is accomplished by impingement of a combination of both heated Coanda air flow and ultraviolet electromagnetic radiation. The combined concentration of heat from the Coanda air flow and the ultraviolet electromagnetic radiation from the ultraviolet bulb is of a sufficient magnitude which allows the web to dry at a higher speed than normal prior art speed.

SUMMARY OF THE INVENTION

The general purpose of the present invention is to provide an air float bar for use in the drying of webs in a dryer, and more particularly, provides an air float bar which includes an ultraviolet bulb integrated into the air float bar for the generation and transmission of ultraviolet electromagnetic radiation by itself or in combination with Coanda air flow upon a web traversing through the dryer. The ultraviolet bulb is located between the Coanda air flow slots and at the point of highest heat transfer, namely between the Coanda air flow slots. Ultraviolet electromagnetic energy passes in a straight forward, direct manner through a lens to impinge upon a traversing web, and is also reflected in an indirect manner from a reflector surface and through the same said lens to impinge upon the traversing web. An air supply duct introduces cooling air into an enclosed terminal chamber and about the area containing the ultraviolet bulb, and overboard through an opposing enclosed terminal area.

According to one embodiment of the present invention, there is provided an air bar with an integral ultraviolet bulb for the drying of a traversing web in a drying system. An air bar header member provides the framework for support and includes V or like channels on each side for the inclusion of an internal diffusion plate. Lips on the upper portion of the air bar header form one edge of Coanda slots, and a fixed position channel member with Coanda curves forms the other portion of the Coanda slots. A removable channel fits inside a fixed position channel and contains an ultraviolet bulb, a reflector and a lens element. An enclosed terminal box juxtaposes with each end of the removable channel member containing the ultraviolet bulb, the reflector, and the lens element. A cooling air supply duct placed in close proximity with one enclosed terminal box supplies cooling air which flows through the enclosed terminal chamber, through the area surrounding the ultraviolet bulb, through an opposing enclosed terminal chamber and finally through an exhaust air duct channel. Oval air supply inlets on the bottom of the air bar header provide air flow for the Coanda slots.

One significant aspect and feature of the present invention is an air float bar containing an integral ultraviolet bulb between Coanda slots where the combination of Coanda air flow and ultraviolet electromagnetic energy drys the traversing web. The traversing web is dried with either Coanda air flow, ultraviolet electromagnetic radiation, or a combination of Coanda air flow and ultraviolet magnetic radiation.

Another significant aspect and feature of the present invention is an air float bar which offers an increased heat transfer rate per size of the air bar unit which is a practical alternative solution to increasing production requirements.

Still another significant aspect and feature of the present invention is direct and indirect radiation of ultraviolet electromagnetic energy through a lens to impinge upon a traversing web in a dryer. The use of cooling air flow across the ultraviolet bulb and the surrounding area cools the ultraviolet bulb.

A further significant aspect and feature of the present invention is an ultraviolet air float bar that can be used to dry products that require high controlled heat and non-contact support. The ultraviolet air float bar can be used in curing of preimpregnated products such as polymer coatings that require airing, and are affected by high air impingement rates. The ultraviolet air float bar can also be used for drying of low solids, and water based coatings that are sensitive to high air impingement during the first stages of drying process. The ultraviolet air float bar can also be used for drying of water based coatings on steel strip webs which require high controlled heat loads. The ultraviolet air float bar is useful for drying webs that cannot endure high temperatures, and that experience frequent web stops. Because of the ability to switch the ultraviolet bulb on or off almost instantly, the air bars can be run with cold convection air for support, and the ultraviolet bulb can be used as the only heat source.

Having thus described embodiments of the present invention, it is a principal object hereof to provide an ultraviolet air float bar for the drying of a traversing web in a dryer.

One object of the present invention is an ultraviolet air float bar which features the use of Coanda air flow with ultraviolet electromagnetic energy.

Another object of the present invention is a removable channel containing an ultraviolet bulb, reflector and a lens for rapid change-out of the ultraviolet bulb.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
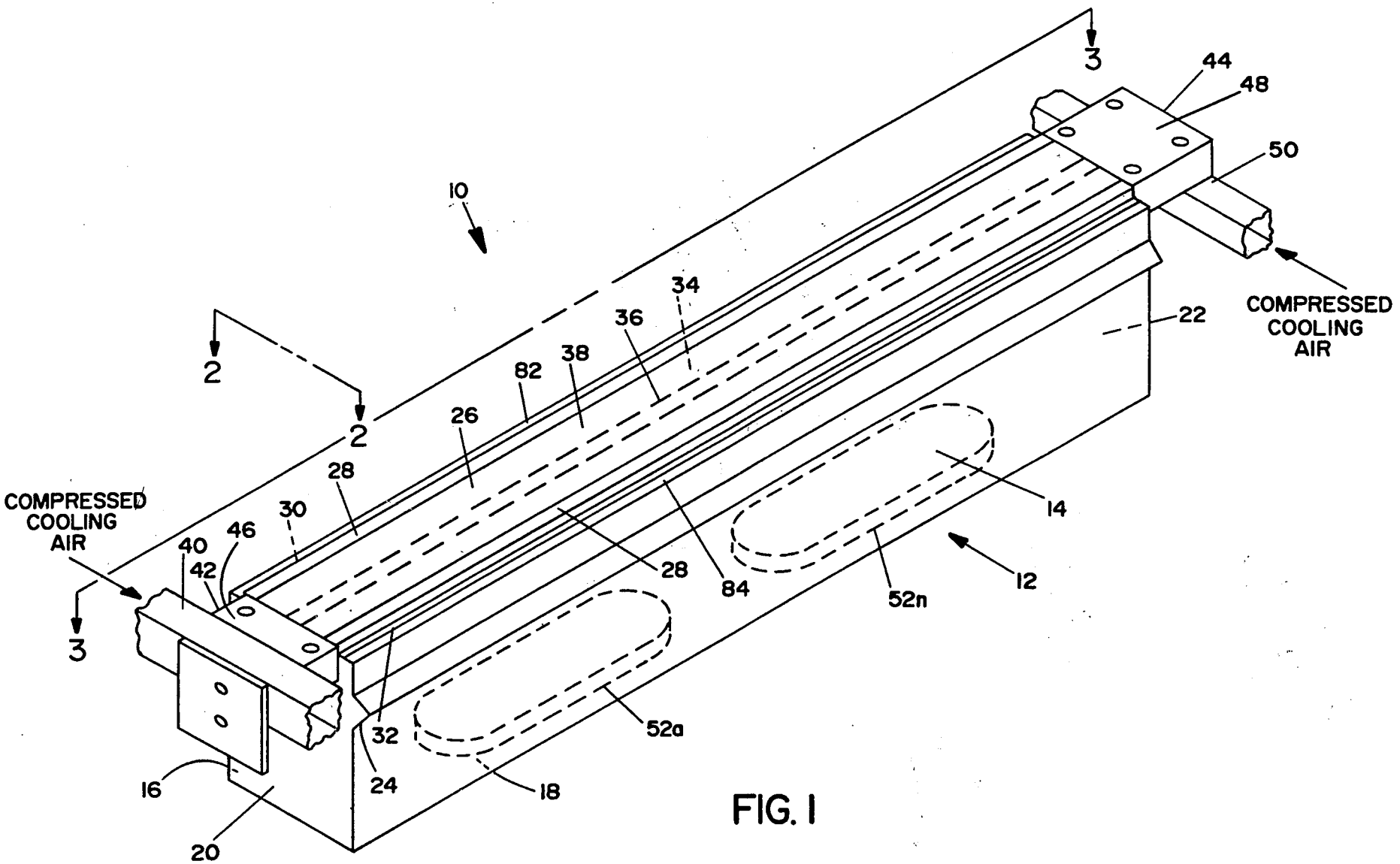
FIG. 1 illustrates a perspective view of the ultraviolet air float bar, the present invention.
Figure 2:
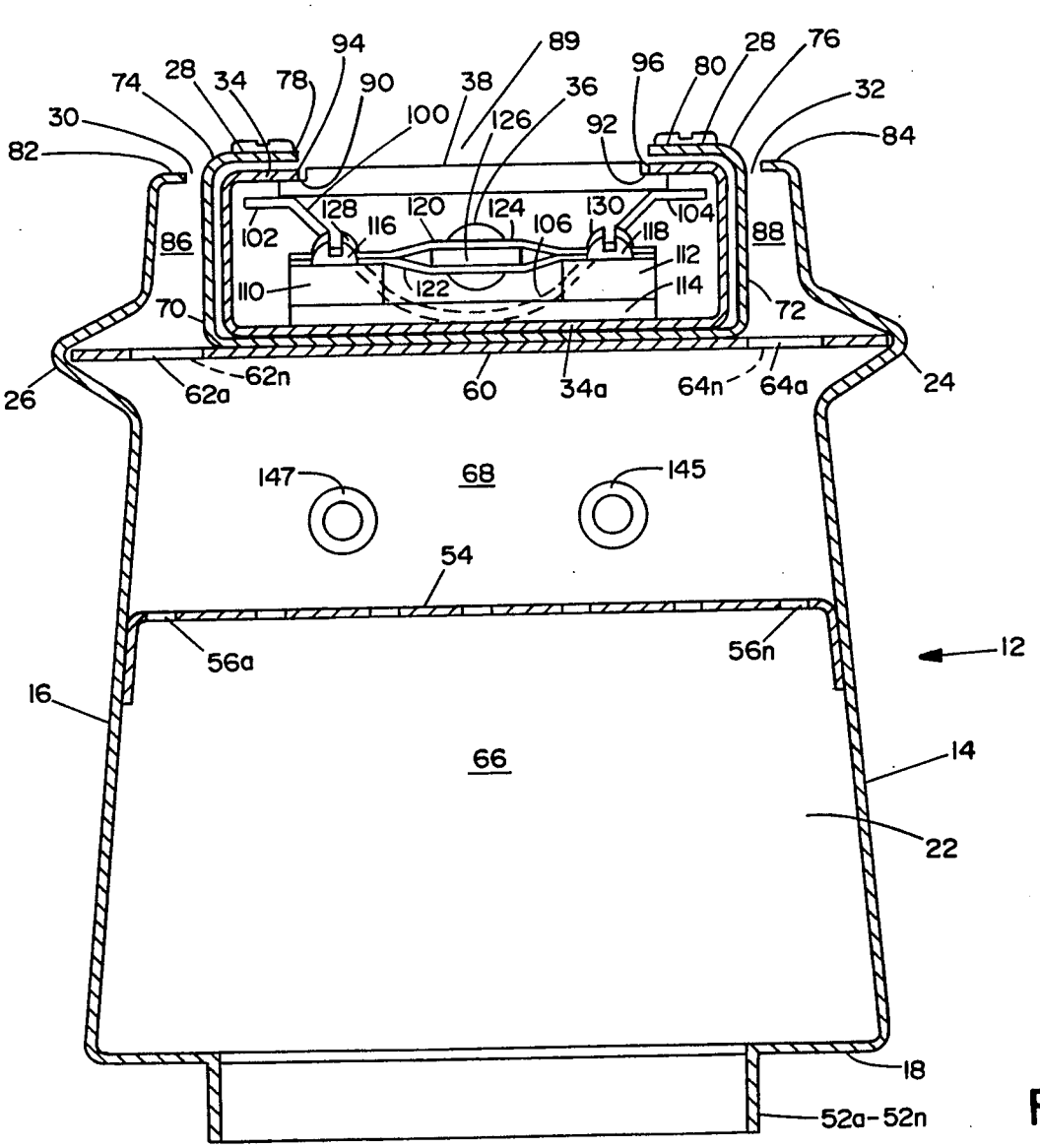
FIG. 2 illustrates a cross-sectional view of the ultraviolet air float bar taken along line 2—2 of FIG. 1.

FIG. 1 illustrates a perspective view of an ultraviolet air float bar 10, the present invention, for use in drying a web in a web dryer. Externally visible members of the ultraviolet air float bar 10 include a channel like air bar header 12 with opposing sides 14 and 16, a bottom 18, and opposing and parallel vertically aligned air bar end plates 20 and 22 affixed between sides 14 and 16. V channels 24 and 26 are formed and aligned horizontally in sides 14 and 16 to accommodate an air bar mounting flange as later described in detail. V channel 26 is illustrated in FIG. 2. A fixed air bar channel 28 aligns longitudinally in a precise manner between the upper regions of sides 14 and 16 to provide for forming longitudinally aligned and uniformly sized Coanda slots 30 and 32 as later described in detail. As later explained in detail in FIG. 2, a second removable channel 34, including an ultraviolet bulb 36 and a quartz lens 38, is accommodated in a sliding fashion by the fixed air bar channel 28. Air supply ducts 40 and 50 fit adjacent to covered terminal chambers 42 and 44 at each end of the removable channel 34 of the ultraviolet air float bar 10 and provides cooling air for the ultraviolet bulb 36. The cooling air passes through the air supply ducts 40 and 50, through the covered terminal chambers 42 and 44, into the removable channel 34, thus cooling the ultraviolet bulb 36, and leaks out of the ultraviolet bulb chamber through the clearance provided between the quartz lens 38 and the cover plates 46 and 48 for the terminal chambers 42 and 44. The covered terminal chamber 42 includes a cover plate 46, and covered terminal chamber 44 includes a cover plate 48. The covered terminal chamber 44 secures above the air duct channel 50. Solvent laden air is kept from the interior of the chamber in which the ultraviolet bulb resides by pressurization of the covered terminal chambers 42 and 44 and the area therebetween. A plurality of oval shaped air inlets 52*a*–52*n* position on the bottom surface 18 of the air bar header 12 to supply drying air through the air bar header 12 to the Coanda slots 30 and 32.

FIG. 2 illustrates a cross-sectional view of the ultraviolet air float bar 10 taken along line 2—2 of FIG. 1 where all numerals correspond to those elements previously described. The removable channel 34 and the ultraviolet bulb 36 are accommodated by the fixed air bar channel 28. A diffuser plate 54 with a plurality of holes 56*a*–56*n* secure between sides 14 and 16 to provide for even flow of drying air from the plurality of oval shaped air inlets 52*a*–52*n*. A support plate 60 positions between V channels 24 and 26, and includes a plurality of holes 62*a*–62*n*. A plurality of holes 64*a*–64*n* align longitudinally in two rows along the support plate 60. The bottom 18, sides 14 and 16 and the diffuser plate 54 define a first chamber 66. The diffuser plate 54, sides 14 and 16, and the support plate 60 define a second chamber 68. The fixed air bar channel 28 secures by welding or other suitable attachment to the support plate 60, and includes sides 70 and 72, Coanda curves 74 and 76, and horizontal planar surfaces 78 and 80 at right angles to sides 70 and 72. Lips 82 and 84, extensions of sides 16 and 14, extend inwardly at right angles to form Coanda slots 30 and 32 between the ends of lips 82 and 84 and Coanda curves 74 and 76, respectively, each slot being of a finite size. Chamber 86 is formed by the fixed air bar channel side 70, the outer portion of support plate 60, the upper portion of side 16 and the lip 82. In a similar fashion, chamber 88 is formed by the fixed air bar channel side 72, the outer portion of support plate 60, the upper portion of side 14 and the lip 84. The area between the Coanda slots 30 and 32, known as the pressure pad 89, includes the quartz lens 38, the ultraviolet bulb 36, and the reflector 100.

Removable channel 34 is illustrated inserted within the fixed air bar channel 28. The quartz lens 38, which can also be manufactured of other material, is essentially rectangularly shaped and includes shoulders 90 and 92 which correspondingly engage beneath ends 94 and 96 of the removable channel 34. A trough-like reflector 100 is illustrated as parabolic, but may also be any other desired geometrical shape and may be fashioned of a suitable material such as stainless steel, aluminum, or other reflective material. The reflector 100 includes planar feet 102 and 104 along the edge of the reflector 100 and a curved portion 106 therebetween. The curved portion 106 of the reflector 100 positions against the bottom member 34*a* of the removable channel 34. The planar feet 102 and 104 spring against the quartz lens 38 to insure engagement of the shoulders 90 and 92 of the quartz lens 38 against the end portions 94 and 96 of the removable channel 34. Rectangular Telflon terminal mounting blocks 110 and 112, for mounting of the ultraviolet bulb 36 and related components, secure to a mounting plate 114 with machine screws 116 and 118. Opposing sides 120 and 122 of a clip style mounting bracket 124 engage over the flat ultraviolet bulb end terminal 126 as machine screws 128 and 130 bring tension to bear upon the clip style mounting bracket 124. While a single ultraviolet bulb 36 is illustrated, a plurality of ultraviolet bulbs mounted in a parallel fashion can be used for applications requiring yet even more ultraviolet electromagnetic radiation. Larger air ultraviolet float bar assemblies can include multiple parallel ultraviolet bulbs to transmit ultraviolet electromagnetic radiation to a traversing web.

Figure 3:
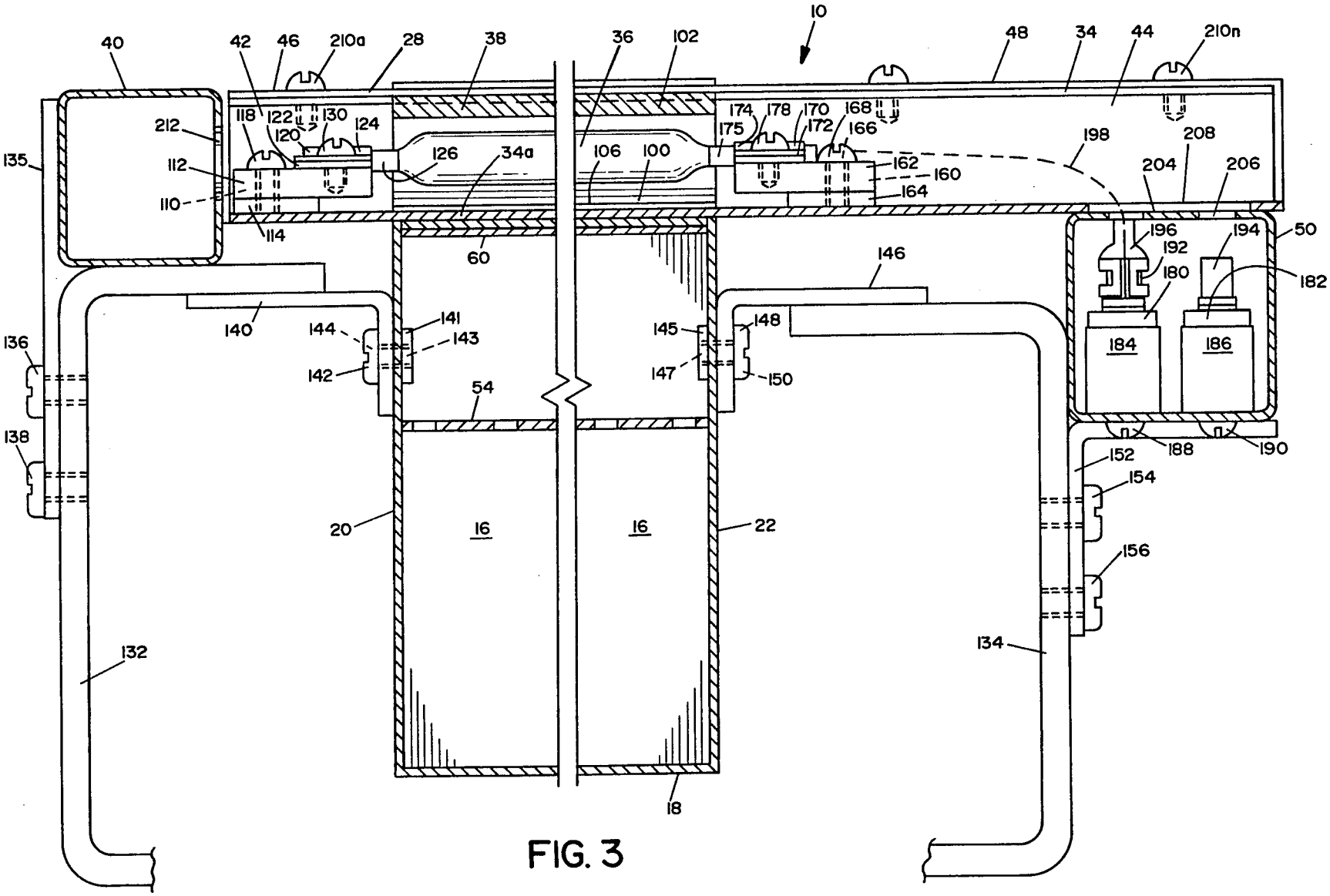
FIG. 3 illustrates a cross-sectional side view of the ultraviolet air float bar taken along line 3—3 of FIG. 1.

FIG. 3 illustrates a cross-sectional side view of the ultraviolet air float bar 10 taken along line 3—3 of FIG. 1 where all numerals correspond to those elements previously described. This FIG. illustrates the ultraviolet air float bar 10 secured to and across dryer framework members 132 and 134. A bracket 135 affixed to the air supply duct 40 secures to framework 132 by machine screws 136 and 138. A bracket 140 aligns beneath the upper horizontal portion of the framework 132 providing vertical positioning of the ultraviolet air float bar 10. Bracket 140 secures to the mounting bases 141 and 143 in the air bar end plate 20 with the machine screws 142 and 144. Another bracket 146 secures to mounting bases 145 and 147 in the air bar end plate 22 by machine screws 148 and 150.

Figure 4:
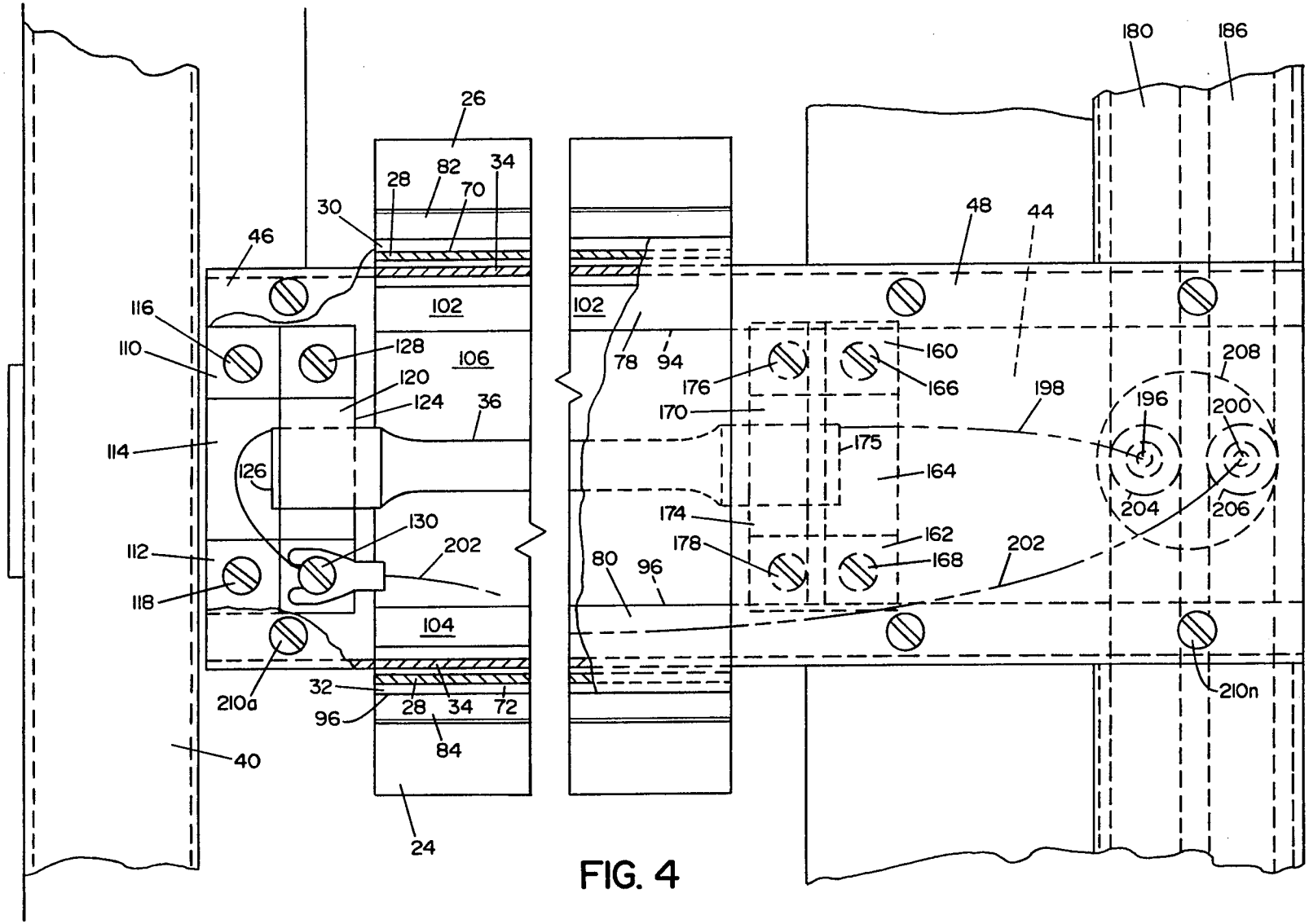
FIG. 4 illustrates a top cutaway view of the ultraviolet air float bar.

The air duct channel 50 secures to the underside of the covered terminal chamber 44. A bracket 152 secures to the bottom of the air duct channel 50 to provide support for the air duct channel 50 and associated components. Bracket 152 secures to the framework 134 by machine screws 154 and 156. Teflon mounting blocks 160 and 162, similar to the Teflon mounting blocks 110 and 112, secure to a mounting plate 164 with machine screws 166 and 168 as also illustrated in FIG. 4. Opposing sides 170 and 172 of the clip style mounting bracket 174 engage over the flat ultraviolet bulb end terminal 175 as machine screws 176 and 178 bring tension to bear upon the clip style mounting bracket 174 as also illustrated in FIG. 4.

Air duct channel 50 houses common electrical bus bars 180 and 182 which extend to and between other parallel mounted ultraviolet air float bars. The bus bars 180 and 182 secure to the upper side of stand-off insulators 184 and 186. Stand-off insulators 184 and 186 secure to the air duct channel with machine screws 188 and 190. Connector pads 192 and 194 secure through the bus bars 180 and 182 to the stand-off insulators 184 and 186. A typical connector cap 196, fitted over and about the connector pad 192 with a wire 198, connects to the ultraviolet bulb end terminal 175 via a mounting bracket 174. Another connector cap 200, similar to the connector cap 196, connects between the connector pad 194 with wire 202 to the opposing ultraviolet bulb end terminal 126 via the mounting bracket 124 as illustrated in FIG. 4. Wires 198 and 202 pass through orifices 204 and 206 in the air duct channel 50 and through orifice 208 in the removable channel 34.

Access cover plate 46 and cover plate 48 secure to the upper side of the removable channel 34 with a plurality of machine screws 210*a*–210*n*, and are removable for the purpose of accessing the end areas of the ultraviolet bulb 36 and the associated electrical hardware. Orifices 212, 204 and 206 in the air supply port cooling air from the air supply ducts 40 and 50 to the covered terminal chambers 42 and 44.

Alternatively, cooling air can be channeled from the covered terminal chambers 42 and 44 to flow about the convex side of the reflector 100.

FIG. 4 illustrates a top cutaway view of the ultraviolet air float bar 10 where all numerals correspond to those elements previously described. The figure illustrates the placement of the ultraviolet bulb 36 within the confines of the removable channel 34, and the location of the mounting brackets 124 and 174 with the associated hardware.

MODE OF OPERATION

Figure 5:
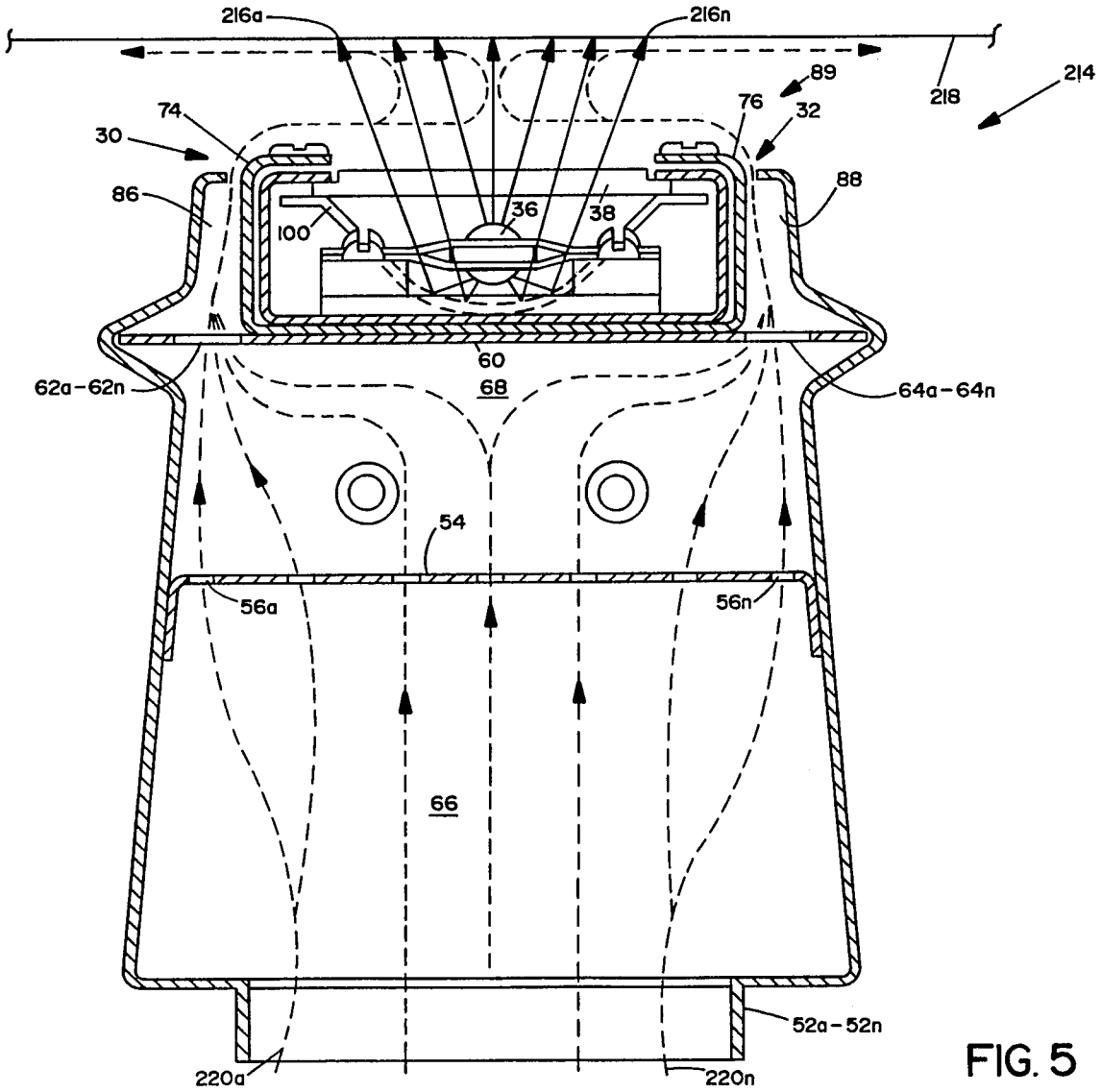
FIG. 5 illustrates a cross-sectional end view of the mode of operation of the ultraviolet air float bar.

FIG. 5 best illustrates the mode of operation 214 of the ultraviolet air float bar 10 where all numerals correspond to those elements previously described. A plurality of ultraviolet electromagnetic energy rays 216*a*–216*n* increase drying capacity because the ultraviolet bulb 36 is located at the point of highest heat transfer, namely between the Coanda slots 30 and 32, and radiate from the ultraviolet bulb 36 either directly or indirectly through the quartz lens 38. The ultraviolet drying energy is transmitted for heating a traversing web 218 being processed in a dryer. A portion of the ultraviolet rays 216*a*–216*n* reflect off the parabolic reflector 100 and through the quartz lens 38 to import ultraviolet drying energy upon and heating the web 218. The wave length of the ultraviolet electromagnetic rays 216*a*–216*n* emitted from the ultraviolet bulb 36 can be short wave with a wave length of 0.78 to 1.2 microns, medium wave length with a wave length of 1.2 to 4.0 microns or long wave length of 4.0 to at least 10 or more microns. The ultraviolet bulb is positioned at a point of maximum energy transfer.

Pressurized air to float the web 218 enters the ultraviolet air float bar 10 through the plurality of oval shaped air inlets 52*a*–52*n* to float the web 218 above the pressure pad 89. From the oval shaped air inlets 52*a*–52*n*, the pressurized air particles 220*a*–220*n* proceed as indicated by dashed arrow lines through the first chamber 66, through holes 56*a*–56*n* of the diffuser plate 54, into the second chamber 68, through the pluralities of holes 62*a*–62*n* and 64*a*–64*n* of the support plate 60, through chambers 86 and 88, through the Coanda slots 30 and 32 along Coanda curves 74 and 76, and then inwardly along the upper surface of the quartz lens 38 and upwardly, thus providing float lift for the web 218 and also carrying away solvent vapors in the web. Direct and indirect ultraviolet energy rays 216*a*–216*n* impinge on the web and heat the web 218 as it passes over the pressure pad 89, thus drying and evaporating solvents from the web 218. This, in combination with impinging flow of air particles 220*a*–220*n*, maximizes the heat transfer in the area of the pressure pad 89.

Output of the ultraviolet bulb 36 can be variably controlled, such as by an SCR so that the amount of energy output transmitted from the ultraviolet bulb 36 includes a range from full power to no power, and any variable range therebetween.

FIGS. 6A–6D illustrate arrangements of pluralities of ultraviolet air float bars with respect to a traversing web 270.

Figure 6A:
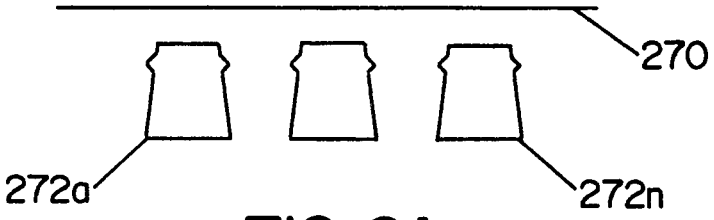
FIGS. 6A–6D illustrate arrangements of pluralities of ultraviolet air float bar systems about a traversing web.

FIG. 6A illustrates a plurality of ultraviolet air float bars 272*a*–272*n* positioned below a traversing web 270.

Figure 6B:
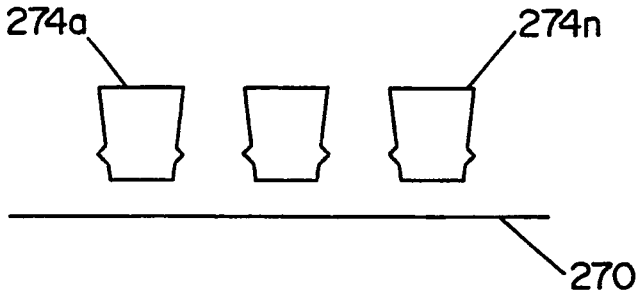

FIG. 6B illustrates a plurality of ultraviolet air float bars 274*a*–274*n* positioned above a traversing web 270.

Figure 6C:
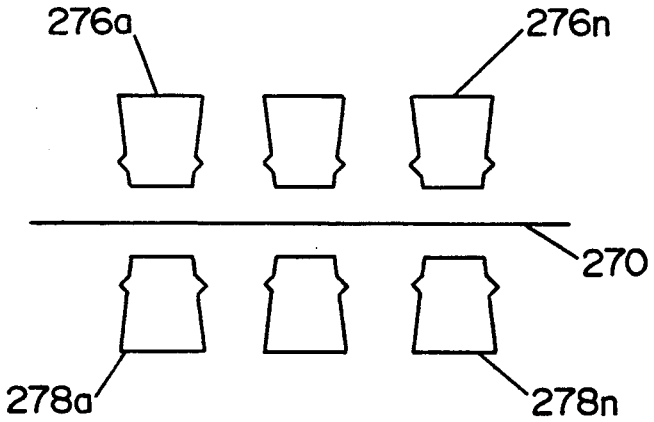

FIG. 6C illustrates a plurality of ultraviolet air float bars 276*a*–276*n* and a plurality of ultraviolet air float bars 278*a*–278*n* in an opposing vertically aligned arrangement about a traversing web 270 for rapid drying of the traversing web 270.

Figure 6D:
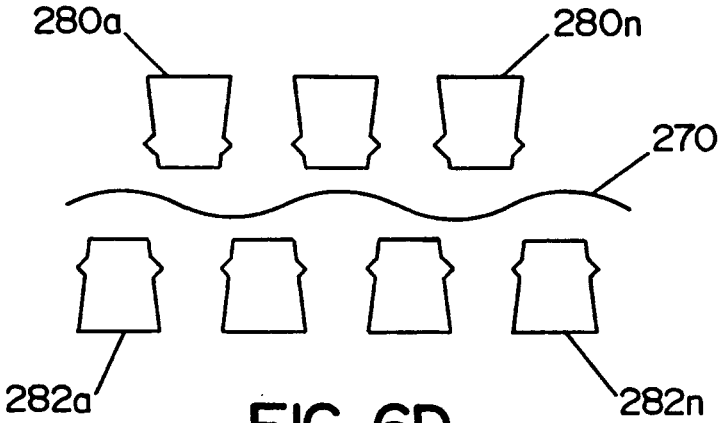

FIG. 6D illustrates a plurality of ultraviolet air float bars 280*a*–280*n* and a plurality of ultraviolet air float bars 282*a*–282*n* arranged in alternating opposing vertical arrangement about a traversing web 270 creating a sinusoidal shape for the traversing web 270.

DESCRIPTION OF THE ALTERNATIVE EMBODIMENTS

Figure 7:
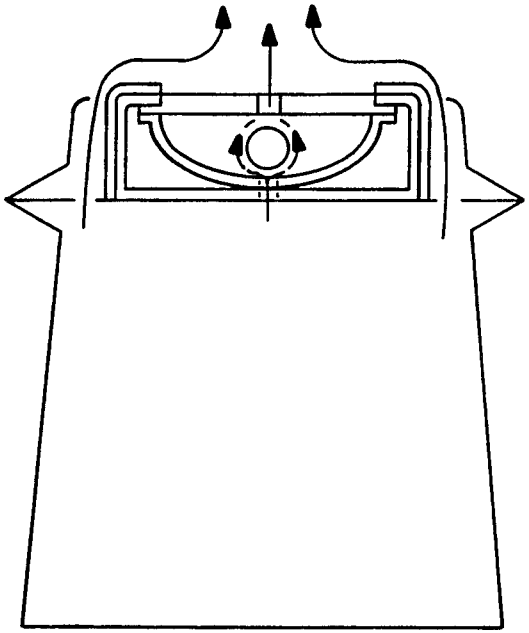

FIG. 7 illustrates air flow from an air bar, which enters through an orifice in the reflector, around the ultraviolet bulb, and out through holes in the lens.

Figure 8:
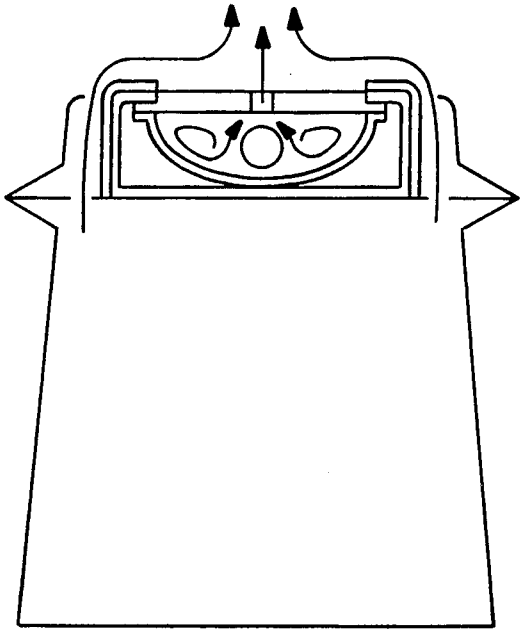

FIG. 8 illustrates air from an air bar, which flows between the reflector and the lens, around and about the ultraviolet bulb, and exits through holes in the lens.

Figure 9:
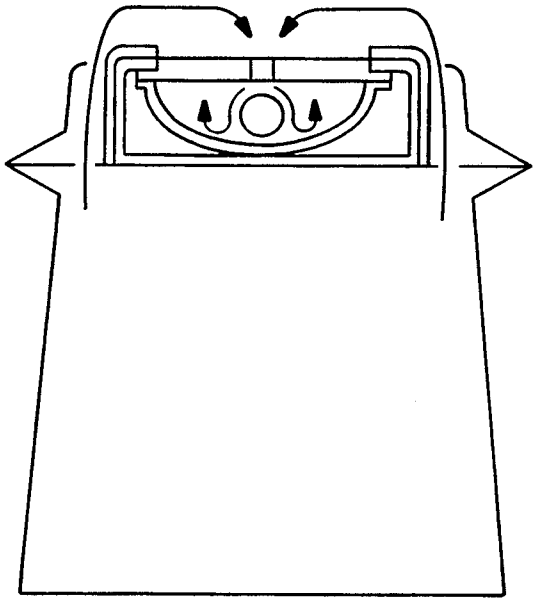
FIGS. 7–9 illustrate alternative methods of cooling the ultraviolet bulb; and, FIGS. 10–12 illustrates spatial relationships between air bars and ultraviolet sources.

FIG. 9 illustrates an air bar, which enters through holes in the lens, passes around and about the ultraviolet bulb, and exits through ends of the removable channel.

Figure 10:
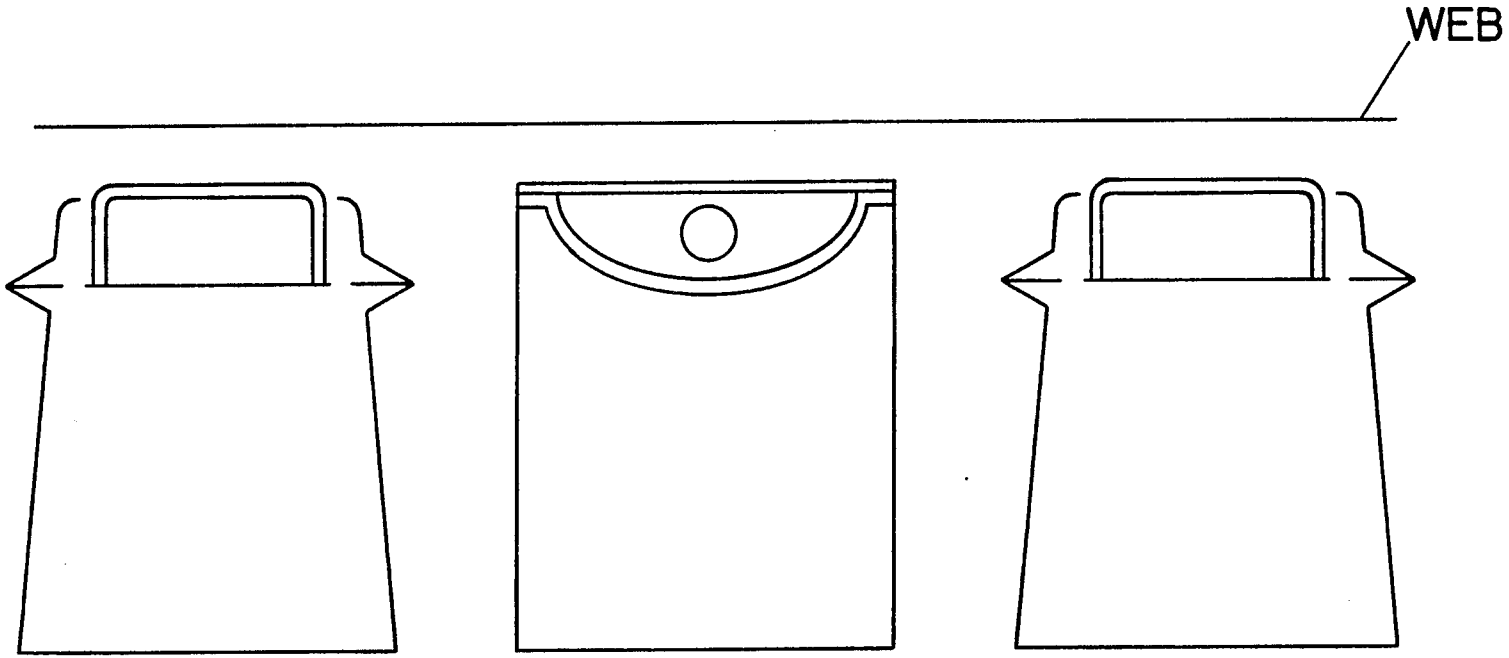

FIG. 10 illustrates ultraviolet bulb and reflector units external to and interposed between two air flotation bars.

Figure 11:
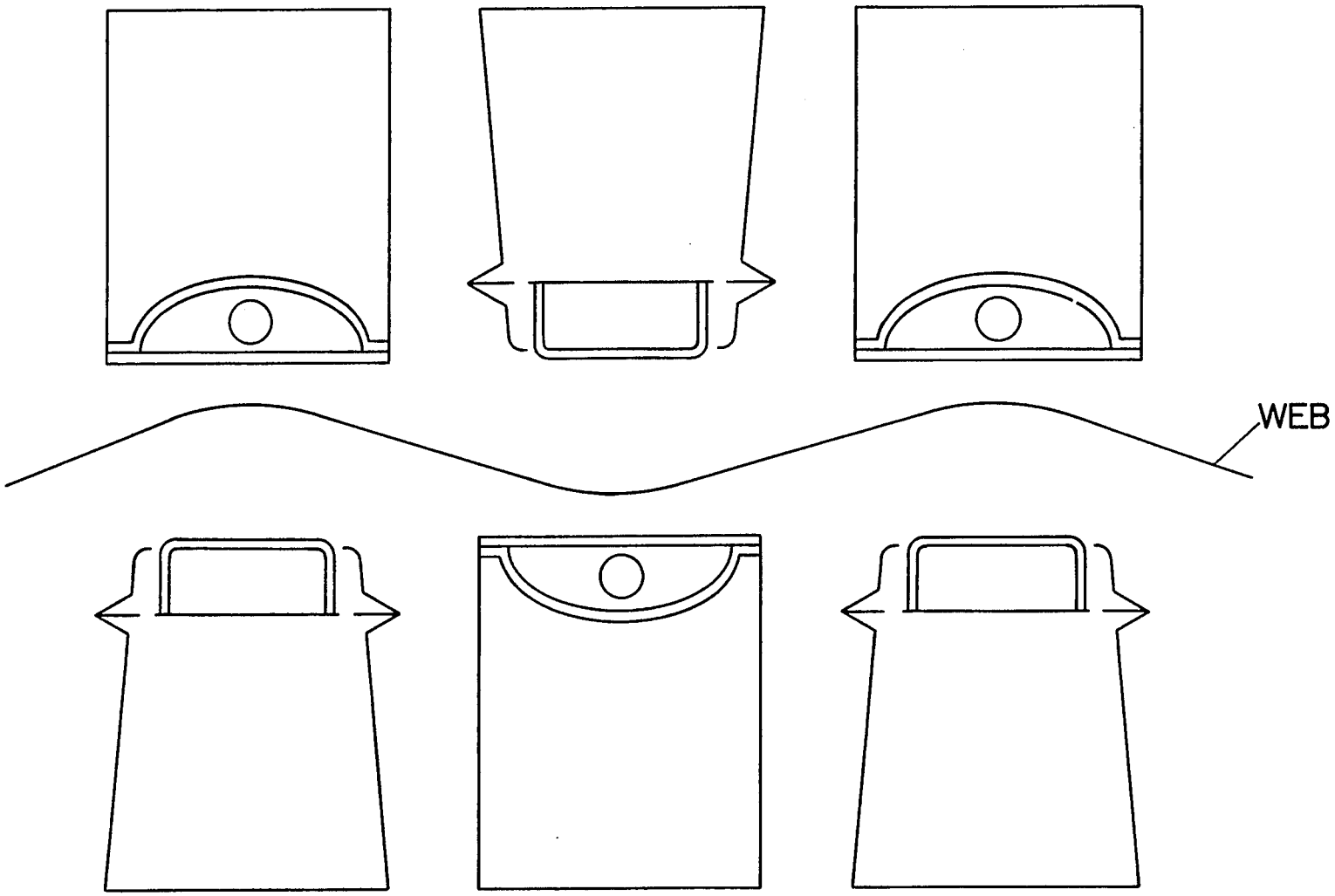

FIG. 11 illustrates horizontally interposed ultraviolet bulb and reflector units in alternate vertical opposition with air floatation bars.

Figure 12:
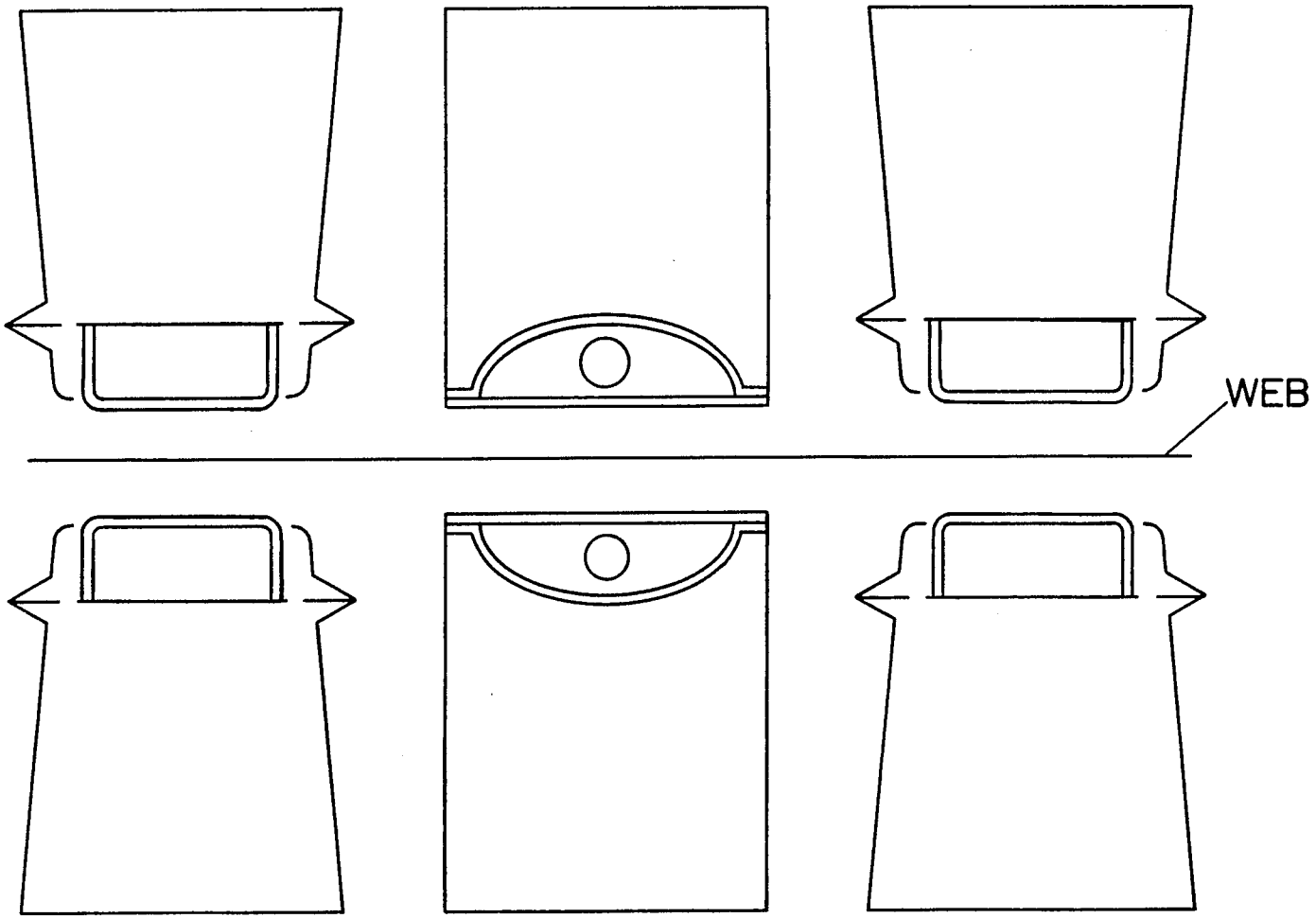

FIG. 12 illustrates horizontally interposed ultraviolet bulb and reflector units with opposing air flotation bars in direct vertical opposition.

Various modifications can be made to the present invention without departing from the apparent scope thereof. The air bar can also be used to cure or dry adhesive coatings on a web, encapsulated coatings, and like applications. The air bar also provides for enhanced quality of drying or treatment of a web.

We claim:

1. Air flotation bar comprising:

a. air bar header including a bottom, with at least one air inlet, opposing sides affixed to said bottom, end plates affixed between said bottom and said sides, a support plate with opposing holes affixed to said sides, a fixed air bar channel secured to said plate and forming Coanda slots between said sides and each side of said air bar channel; and, b. a removable channel supported in said air bar channel, opposing electrical connector means in said removable channel, at least one ultraviolet bulb affixed between said connector means, a lens engaged beneath upper ends of said removable channel.

2. Air flotation bar comprising:

a. air bar header including a bottom, with at least one air inlet, opposing sides affixed to said bottom, end plates affixed between said bottom and said sides, a support plate with opposing holes affixed to said sides, a fixed air bar channel secured to said plate and forming Coanda slots between said sides and each side of said air bar channel; and, b. a removable channel supported in said air bar channel, opposing terminal block means in said removable channel, at least one ultraviolet bulb affixed between said terminal block means, a quartz lens engaged beneath upper ends of said removable channel, a reflector positioned between said bulb and said removable channel whereby said quartz lens provides a pressure pad area between said Coanda slots.

3. Air flotation bar of claim 2 comprising means for passing air between ends of said removable channel for cooling said bulb and flushing out solvent laden air.

4. Air flotation bar of claim 2 wherein said air passage means is pressurized by cool air and air flow is an open end to an opening in an underside surface of said removable channel.

5. Air flotation bar of claim 2 including opposing Coanda curves on said air bar channel.

6. Air flotation bar of claim 2 including a longitudinal cooling hole in said quartz lens.

7. Air flotation bar of claim 2 wherein ultraviolet electromagnetic energy radiates directly through said quartz lens to transmit ultraviolet energy to the traversing web.

8. Air flotation bar of claim 2 wherein ultraviolet electromagnetic energy reflects off said reflector and through said quartz lens to impart ultraviolet energy to the traversing web.

9. Air flotation bar of claim 2 wherein said ultraviolet bulb is positioned at the point of optimum energy transfer.

10. Air flotation bar of claim 2 wherein Coanda air flow impinges on the traversing web to dry said web.

11. Air flotation bar of claim 2 wherein ultraviolet electromagnetic energy impinges on the traversing web to dry said web.

12. Air flotation bar of claim 2 wherein Coanda air flow and ultraviolet electromagnetic energy impinges on the traversing web to dry said web.

13. Air flotation bar of claim 2 comprising a plurality of said ultraviolet air float bars below the traversing web.

14. Air flotation bar of claim 2 comprising a plurality of said ultraviolet air flotation bars above the traversing web.

15. Air flotation bar of claim 2 comprising a plurality of vertically aligned opposing ultraviolet air flotation bars.

16. Air flotation bar of claim 2 comprising a plurality of alternatively opposing vertically aligned ultraviolet air flotation bars.

17. An apparatus for ultraviolet radiation enhancement processing of a traveling web of material suspended on a cushion of air comprising:

a. a housing;

b. means for supplying pressurized air to said housing;

c. means removably coupled within said housing for irradiating said traveling web of material with ultraviolet radiation; and, d. means responsively coupled to said supply means and said housing for cushioning said traveling web on pressurized air.

18. An apparatus according to claim 17 further comprising means responsively coupled to said supplying means and said irradiating means for cooling said irradiating means with said pressurized air.

19. An apparatus according to claim 18 further comprising means responsively coupled to said cooling means for ensuring that said pressurized air used for cooling said irradiating means has not previously been used by said cushioning means to cushion said traveling web.

20. An air flotation bar comprising:

a. air bar header including a bottom, opposing sides affixed to said bottom, end plates affixed between said bottom and said sides, a support plate with opposing holes affixed to said sides, a fixed air bar channel secured to said plate and forming air discharged slots between said sides of each side of said air bar channel for web-supporting air; and, b. a removable channel supported in said air bar channel, opposing electrical connector means in said removable channel, at least source mounted between said connector means for emitting ultraviolet radiation to impinge on a web passing and being supported by said air flotation bar, and a lens arranged at upper ends of said removable channel whereby said lens provides a pressure pad area between said air discharge slots.

21. An air flotation bar according to claim 21 wherein the path of ultraviolet energy radiating from said source is directed through said lens to transmit ultraviolet energy to the traversing web.

* * * * *